United States Patent [19]

Tanaka et al.

[11] 4,348,994

[45] Sep. 14, 1982

[54] INTERNAL COMBUSTION ENGINE

[75] Inventors: Toshiaki Tanaka; Yukihiro Etoh, both of Kanagawa, Japan

[73] Assignee: Nissan Motor Company, Limited, Yokohama, Japan

[21] Appl. No.: 161,370

[22] Filed: Jun. 20, 1980

[30] Foreign Application Priority Data

Jun. 22, 1979 [JP] Japan ..... 54-78696

[51] Int. Cl.[3] ..... F02D 17/02

[52] U.S. Cl. ..... 123/198 F; 261/23 A

[58] Field of Search ..... 123/198 F; 261/23 A

[56] References Cited

U.S. PATENT DOCUMENTS

| | | | |
|---|---|---|---|
| 2,623,617 | 12/1952 | Snyder | 123/198 F |
| 3,578,116 | 5/1971 | Nakajima et al. | 123/198 F |
| 4,080,948 | 3/1978 | Dolza | 123/198 F |
| 4,106,471 | 8/1978 | Nakajima et al. | 123/198 F |
| 4,130,102 | 12/1978 | Churchill | 123/198 F |

FOREIGN PATENT DOCUMENTS

| | | |
|---|---|---|
| 720661 | 3/1953 | United Kingdom . |
| 1221470 | 4/1975 | United Kingdom . |

*Primary Examiner*—Ira S. Lazarus

*Attorney, Agent, or Firm*—Schwartz, Jeffery, Schwaab, Mack, Blumenthal & Koch

[57] ABSTRACT

An internal combustion engine is disclosed which includes first and second cylinder units each including at least one cylinder, a carburetor with first and second induction passages each having therein a throttle valve rotatable in phase with the other, and first and second intake passages connecting the first and second induction passage to the first and second cylinder units, respectively. The first and second intake passages are communicated near their upstream end. A swing valve is provided which is normally placed in a first position interrupting communication between the first and second intake passages and rotatable to a second position interrupting communication between the second induction passage and the second intake passage. Means are provided for rotating the swing valve to the second position at low load conditions.

5 Claims, 5 Drawing Figures

INTERNAL COMBUSTION ENGINE

BACKGROUND OF THE INVENTION

1. Field of the Invention

This invention relates to an internal combustion engine of the split type operable on less than all of its cylinders when the engine is below a given value.

2. Description of the Prior Art

In general, internal combustion engines demonstrate higher efficiency and thus higher fuel economy when running under higher load conditions. In view of this fact, split type internal combustion engines have already been proposed which include active cylinders which are always active and inactive cylinders being inactive when the engine load is below a given value. Suitable means is provided for cutting off the flow of fuel (or air-fuel mixture) to the inactive cylinders so as to place the engine operation in a split engine mode where the engine operates only on the active cylinders at low load conditions. This relatively increases active cylinder loads at low load conditions, resulting in higher fuel economy.

In order to cut off the flow of fuel (or air-fuel mixture) to the inactive cylinders at low load conditions, an attempt has been made to force close the intake valves associated with the inactive cylinders regardless of crankshaft rotation. However, this requires a complex intake valve control mechanism for holding the intake valves closed during low load conditions.

With fuel injection type engines, it is conventional practice to suspend the operation of the fuel injection valves associated with the inactive cylinders during low load conditions. However, this requires fuel injection valves numbered according to the cylinders and a sophisticated fuel supply system. In addition, this system cannot be applied to carburetor type engines.

SUMMARY OF THE INVENTION

It is therefore one object of the present invention to provide a split type internal combustion engine which is simple in structure and inexpensive to produce.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENT

Figure 1:
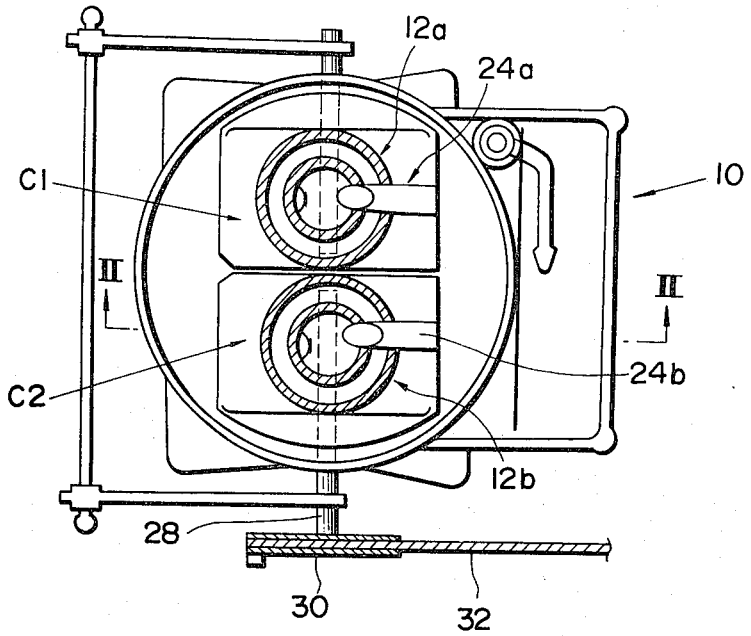
FIG. 1 is a plan view showing a carburetor used in the engine of the present invention.
Figure 2:
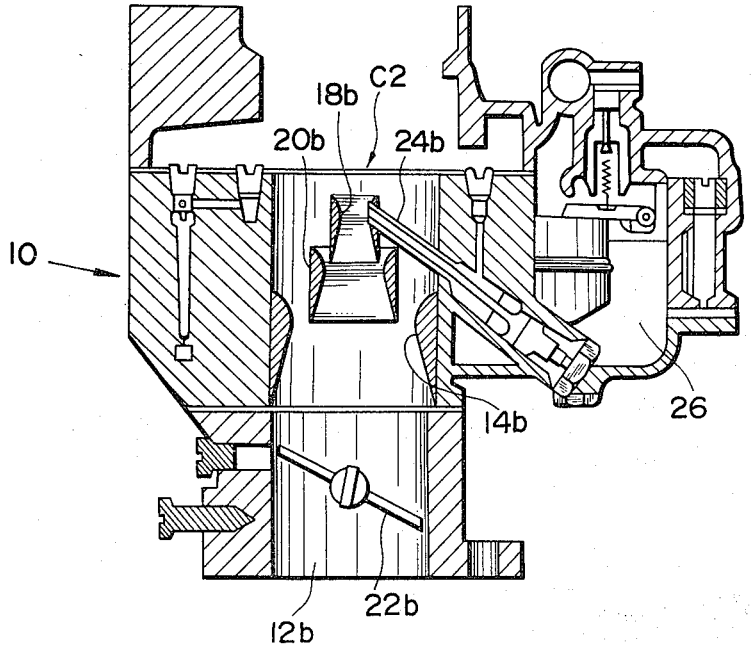
FIG. 2 is a sectional taken along the line II—II of FIG. 1.

Referring now in greater detail to the drawings, FIGS. 1 and 2 illustrate a duplex carburetor 10 having a pair of simple carburetors $C_1$ and $C_2$ which are generally the same in structure. Accordingly, like parts included in the carburetors $C_1$ and $C_2$ are designated by the same reference numeral and followed by letters a and b, respectively.

The carburetor $C_2$ has an induction passage **12*b* formed therethrough. The induction passage 12*b* is provided therein with a large venturi 14*b* and small venturis 18*b* and 20*b* upstream of the large venturi 14*b*. The induction passage 12*b* is also provided near its downstream end with a throttle valve 22. Fuel is fed from a float chamber 26 through a main fuel nozzle 24*b* into the small venturi 18*b*. The amount of fuel to the small venturi 18*b* is determined by the rate of air flow through the induction passage 12*b***.

Figure 4:
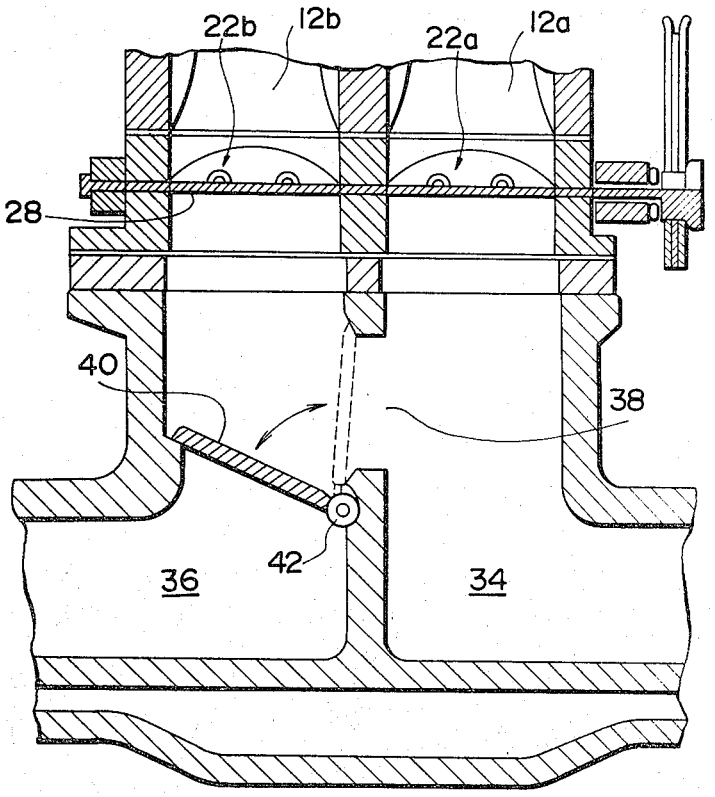
FIG. 4 is a sectional view taken along the line IV—IV of FIG. 3.

The throttle valves **22*a* and 22*b* are mounted on a throttle shaft 28, as best shown in FIG. 4, so that they can rotate in phase. The throttle shaft 28 has its one end secured to a throttle angle disc 30 around which a throttle wire 32 is wounded. Pulling the throttle wire 32 causes rotation of the throttle shaft 28 to open the throttle valves 22*a* and 22*b*** in phase.

Figure 3:
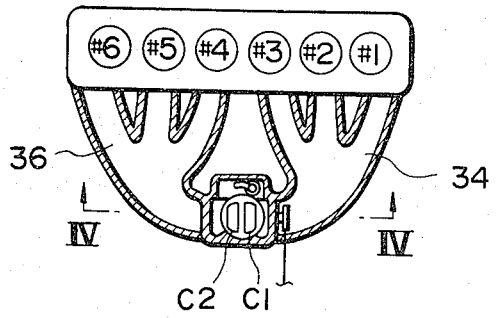
FIG. 3 is a sectional view showing the parts located downstream of the throttle valves.

Referring to FIGS. 3 and 4, the induction passages **12*a* and 12*b* are connected at their downstream end with first and second intake passages 34 and 36, respectively. The first intake passage 34 leads to active cylinders #1 to #3 being always active and the second intake passage 36 leads to inactive cylinders #4 to #6 being inactive when the engine load is below a given value. The first and second intake passages 34 and 36 are communicated with each other through a passage 38 formed near the upstream ends of the intake passages 34 and 36. A swing valve 40 is provided for rotation about a valve shaft 42 toward a first position closing the passage 38 and toward a second position interrupting communication between the induction passage 12*b* and the second intake passage 36**.

Figure 5:
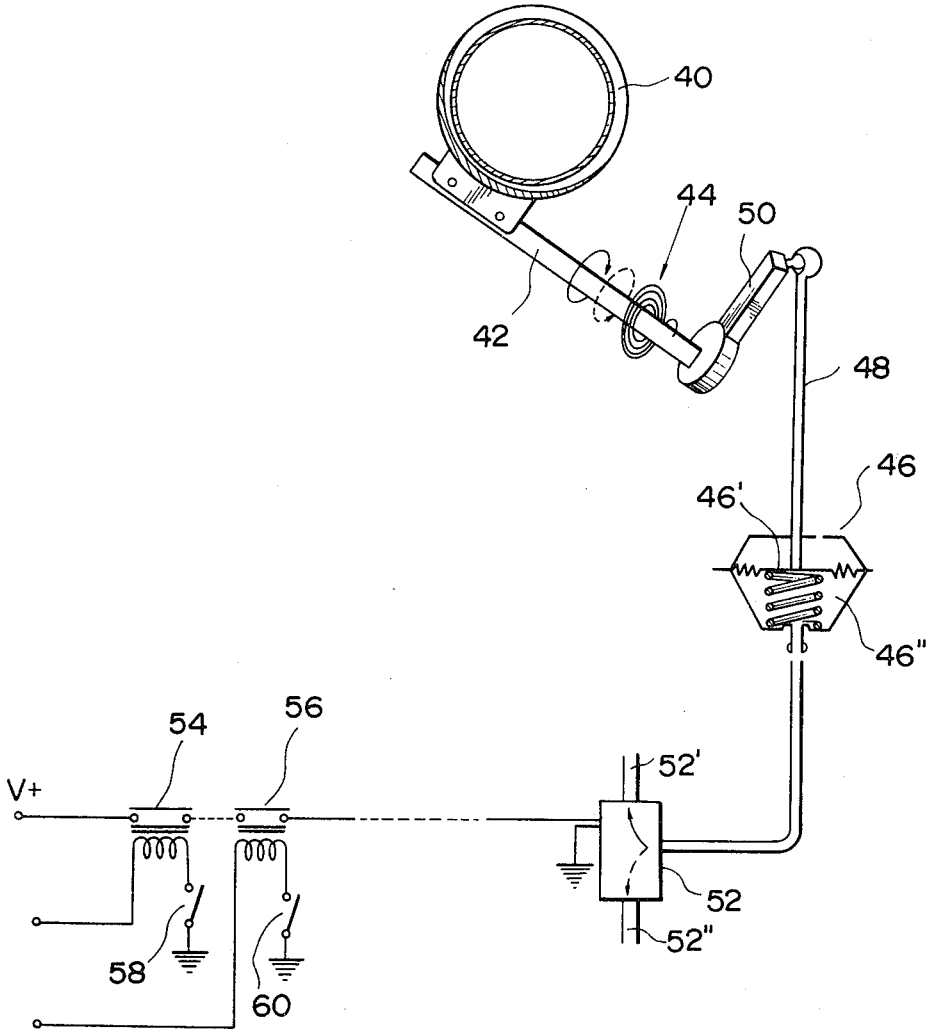
FIG. 5 is a schematic view showing a valve drive mechanism used in the engine of the present invention.

Referring to FIG. 5, there is illustrated a valve drive device for rotating the swing valve 40 selectively to the first and second positions. The swing valve 40 is normally held in the first position by the force of a return spring 44 wounded around the valve shaft 42. The valve drive mechanism includes a servo mechanism 46 which has a diaphragm 46' disposed within a casing to define therewith two chambers on the opposite sides thereof. The diaphragm 46' is drivingly connected to the valve shaft 42 through a linkage 48 and a lever 50. Displacement of the diaphragm 46' is transmitted through the linkage 48 to the lever 50 which rotates the valve shaft 42. The working chamber 46'' is connected to the outlet of a three-way solenoid valve 52 which has an atmosphere inlet 52' communicated with atmospheric pressure and a vacuum inlet 52'' communicated with a high vacuum. The solenoid valve 52 normally provides communication between its outlet and the atmosphere inlet 52' to introduce atmospheric pressure to the working chamber 46'' of the servo mechanism 46. Under this conditions, the swing valve 40 is held at the first position closing the passage 38 under the force of the return spring 44. When energized, the solenoid valve 52 establishes communication between its outlet and the vacuum inlet 52'' to introduce a high vacuum to the working chamber 46'' of the servo mechanism 46 so as to move the diaphragm 46' downward in the drawing. This movement of the diaphragm 46' is transmitted through the linkage 48 to the lever 50 which thereby rotates the swing valve 40 to the second position closing the second intake passage 36 against the force of the return spring 44.

The three-way solenoid valve 52 is connected to a DC power source through a series circuit of first and second relay operated switches 54 and 56. The first relay operated switch 54 is turned on with a load sensitive switch 58 closing at engine loads below a predetermined level. The load sensitive switch 58 may be in the form of a throttle switch adapted to become conductive when the throttle opening is below a predetermined level or alternatively a vacuum sensitive switch adapted to become conductive when the manifold vacuum is below a predetermined level. The second relay operated switch 56 is turned on with a speed sensitive switch 60 closing at engine speeds below a predetermined level.

The operation of the present invention is as follows:

Assuming first that the engine load and/or the engine speed is above the predetermined level, at least one of the switches 58 and 60 is open to disconnect the three-way solenoid valve 52 from the power source. Thus, the solenoid valve 52 provides communication between the outlet and the atmosphere inlet 52' to introduce atmospheric air into the working chamber 46'' of the servo mechanism 46 so as to urge the diaphragm 46' upward in the drawing. Consequently, the swing valve 40 is held in the first position closing the passage 38 under the force of the return spring. As a result, an air-fuel mixture is delivered into all of the cylinders #1 to #6 and the engine operation is placed in a full engine mode.

In the engine load and engine speed become below the respective predetermined levels, both of the switches 58 and 60 are turned on to render the relay operated switches 54 and 56 conductive, thereby connecting the three-way solenoid valve 52 to the power source. Thus, the solenoid valve 52 establishes communication between the outlet and the vacuum inlet 52'' to introduce a high vacuum into the working chamber 46'' of the servo mechanism 46 so as to move the diaphragm 46' downward in the drawing. The displacement of the diaphragm 46' is transmitted through the linkage 48 to the lever 50 which thereby rotate the swing valve 40 to the second position against the force of the return spring 44, closing the second intake passage 36 to cut off the flow of the air-fuel mixture to the inactive cylinders #4 to #6. As a result, the engine operation is shifted into a split engine mode. The load on the active cylinders #1 to #3 relatively increases during the split engine mode of operation since the inactive cylinders #4 to #6 are suspended.

In order to minimize pumping losses in the inactive cylinders for further fuel economy during a split engine mode of operation, it is preferable to introduce exhaust gases or air into the second intake passage 36 downstream of the swing valve 40.

Since the amount of the air-fuel mixture supplied to the active cylinders #1 to #3 is doubled when the engine operation is shifted from its full engine mode to a split engine mode, the total engine output power is held still. Accordingly, it is not required to change the throttle opening between the full and split engine modes and there is no need for any intake air flow rate correction means.

While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) a carburetor with first and second induction passages each having therein a throttle valve rotatable in phase with the other;

(c) an intake manifold having an inlet passage and first and second intake passages respectively leading to said first and second cylinder units, said inlet passage being divided, by a partition, into first and second inlet passages respectively connected at their upstream ends to said first and second induction passages and respectively connected at their downstream ends to said first and second intake passages, said partition being formed with a through-hole communicating with said first and second inlet passages;

(d) a swing valve normally placed in a first position closing said through-hole to interrupt communication between said first and second inlet passages, said swing valve being rotatable to a second position opening said through-hole to provide communication between said first and second inlet passages and interrupting communication between said second inlet passage and said second intake passage; and (e) means responsive to low engine load conditions for disabling said second cylinder unit and rotating said swing valve to said second position.

2. An internal combustion engine according to claim 1, wherein said means comprises a load sensitive switch adapted to become conductive when the engine load is below a predetermined level, a signal source, and a valve drive mechanism responsive to a signal fed through said load sensitive switch from said signal source for rotating said swing valve to said second position.

3. An internal combustion engine according to claim 2, wherein said load sensitive switch is in the form of a throttle switch adapted to become conductive when the degree of opening of said throttle valves is below a predetermined level.

4. An internal combustion engine according to claim 2, wherein said load sensitive switch is in the form of a vacuum sensitive switch adapted to become conductive when the manifold vacuum is below a predetermined level.

5. An internal combustion engine according to claim 2, wherein said valve drive mechanism comprises a pneumatic device responsive to a vacuum for rotating said swing valve to said second position, and a three-way solenoid valve responsive to the signal for introducing a vacuum to said pneumatic device.

* * * * *